US005257724A

United States Patent [19]

Steijns

[11] Patent Number: 5,257,724

[45] Date of Patent: Nov. 2, 1993

[54] TAMPER EVIDENT TRIGGER SPRAYER BOTTLE CAP/BOTTLE NECK ASSEMBLY

[75] Inventor: Emile B. Steijns, Lierop, Netherlands

[73] Assignee: AFA Products Inc, Forest City, N.C.

[21] Appl. No.: 840,758

[22] Filed: Feb. 24, 1992

[51] Int. Cl.[5] ..... B67B 5/00

[52] U.S. Cl. ..... 222/153; 222/383

[58] Field of Search ..... 222/153, 383, 385; 215/252, 258, 330, 346

[56] References Cited

U.S. PATENT DOCUMENTS

| | | | |
|---|---|---|---|
| 4,345,691 | 8/1982 | Burke | 215/216 |
| 4,746,035 | 5/1988 | Anderson et al. | 215/252 X |
| 4,760,941 | 8/1988 | Salmon et al. | 222/153 |
| 4,781,311 | 11/1988 | Dunning et al. | 215/330 X |
| 4,895,265 | 1/1990 | Luch et al. | 215/31 |
| 4,909,404 | 3/1990 | Rozenberg | 215/220 |
| 4,919,285 | 4/1990 | Roof et al. | 215/230 |
| 4,946,074 | 8/1990 | Grogan | 222/153 |
| 4,971,227 | 11/1990 | Knickerbocker et al. | 222/153 |
| 5,143,237 | 9/1992 | Lindsey et al. | 215/330 |
| 5,169,033 | 12/1992 | Shay | 215/330 X |

*Primary Examiner*—Gregory L. Huson
*Attorney, Agent, or Firm*—Thomas R. Vigil

[57] ABSTRACT

The tamper evident trigger sprayer bottle cap/bottle neck assembly comprises: a trigger sprayer including a body and a fluid intake portion, the fluid intake portion having retaining structure protruding laterally outwardly therefrom for retaining an open top bottle cap thereon; a bottle cap comprising a top portion, a cylindrical wall depending from the top portion, and a tamper evident ring depending from the cylindrical wall, the top portion having a central opening therein, the fluid intake portion extending upwardly through the central opening and the cap being supported on the retaining structure; sealing structure associated with the retaining structure and the bottle cap for effecting a seal between them when the bottle cap is mounted on a bottle neck to a fully connected position, the tamper evident ring being frangibly connected to the cylindrical wall by a plurality of spaced apart easily breakable webs or filets molded to and extending between the tamper evident ring and the cylindrical wall of the open top bottle cap, having engaging means for engaging structure on a bottle neck, being a continuous ring without a pull tab, and being mounted to a fully connected position on the bottle neck when the bottle cap is mounted on a bottle neck to a fully connected position, and the cylindrical wall having bottle neck connecting structure on the inside thereof engagable with cap connecting structure on a bottle neck; and a bottle neck comprising: a short tubular portion at the top of a bottle or similar container or receptacle and having an outer generally cylindrical surface extending to a top annular edge; cap connecting structure on the outer surface just below the top edge; and engaging structure below the cap connecting structure for engaging the engaging structure on the tamper evident ring.

40 Claims, 3 Drawing Sheets

TAMPER EVIDENT TRIGGER SPRAYER BOTTLE CAP/BOTTLE NECK ASSEMBLY

BACKGROUND OF THE INVENTION

1. Field of the Invention The present invention relates to a tamper evident trigger sprayer bottle cap/bottle neck assembly for mounting a trigger sprayer to a bottle neck. More specifically, the present invention relates to a specially configured bottle cap having a top wall with a central opening therethrough for receiving a fluid intake portion of the sprayer and a cylindrical wall depending from the top wall. Bottle neck engaging structure, such as threads and/or ratchet teeth, for engaging similar structure on a specially configured bottle neck are provided on the inner surface of the cylindrical wall and a tamper evident ring is frangibly connected to the lower edge of the cylindrical wall. The tamper evident ring has one or more projections on the inner cylindrical surface thereof for engaging one or more projections on the outer surface of the bottle neck.

2. Description of the Related Art Including Information Disclosed Under 37 cFR §1.97-1.99

Heretofore it has been proposed in the field of trigger sprayers to provide nozzle assemblies with tamper evident structure to indicate if an attempt has been made to rotate the nozzle. See, for example, the Knickerbocker et al. U.S. Pat. No. 4,971,227.

Also in the trigger sprayer art, it has been proposed to provide a breakable locking device between a trigger of the trigger sprayer and the body of the trigger sprayer which breaks or falls off when the trigger is squeezed to show evidence of tampering. Alternatively, the locking device can engage the underside of the trigger and snap fit into the front of a nozzle cap located adjacent the trigger. Tampering is evident if the locking device is removed from the nozzle cap or disengaged from the trigger. See, for example, the Grogan U.S. Pat. No. 4,946,074.

Further, a tamper proof bottle cap assembly has been proposed including a bottle cap with a closed top and a depending ring which has projections on the inner surface thereof adapted to engage projections on the outer surface of a tubular bottle neck such that when an attempt is made to rotate the cap, the projections on the inside of the ring will engage projections on the outer surface of the bottle neck and prevent rotation of the ring. See U.S. Pat. Nos. 4,895,265; 4,909,404; and, 4,919,285.

Still further it has been proposed to provide ratchet teeth on the inside of an open top bottle cap for engaging in a ratchet manner ratchet teeth on the outer surface of a bottle neck. See, for example, the Burke U.S. Pat. No. 4,345,691.

However, heretofore, it has not been proposed to provide a tamper evident trigger sprayer bottle cap/-bottle neck assembly. As will be described in greater detail hereinafter, according to the present invention there is provided a tamper evident trigger sprayer bottle Cap/bottle neck assembly which can also be child resistant. The assembly includes a bottle cap having an open top, a cylindrical wall depending therefrom with bottle engaging structure on the inner surface thereof and a tamper evident ring frangibly connected to a lower annular edge of the cap. The cap engages a bottle neck having cap engaging structure thereon and ratchet type structure for engaging ratchet type structure on the inner surface of the tamper evident ring. With sufficient twist or torque of the cap in a unthreading direction, the ratchet type structures will block rotation of the ring and the ring will break off from the cap indicating that the tamper evident sprayer bottle cap/bottle neck assembly of the present invention has been tampered with.

SUMMARY OF THE INVENTION

According to the present invention there is provided a tamper evident, child resistant trigger sprayer bottle cap/bottle neck assembly comprising: a trigger sprayer including a body and a fluid intake portion, the fluid intake portion having retaining structure protruding laterally outwardly therefrom for retaining an open top bottle cap thereon; a bottle cap comprising a top portion, a cylindrical wall depending from the top portion, and a tamper evident ring depending from the cylindrical wall, the top portion having a central opening therein, the fluid intake portion extending upwardly through the central opening and the cap being supported on the retaining structure; sealing structure associated with the retaining structure and the bottle cap for effecting a seal between them when the bottle cap is mounted on a bottle neck to a fully connected position, the tamper evident ring being frangibly connected to the cylindrical wall by a plurality of spaced apart easily breakable webs or filets molded to and extending between the tamper evident ring and the cylindrical wall of the open top bottle cap, having engaging means for engaging structure on a bottle neck, being a continuous ring without a pull tab, and being mounted to a fully connected position on the bottle neck when the bottle cap is mounted on a bottle neck to a fully connected position, and the cylindrical wall having bottle neck connecting structure on the inside thereof engagable with cap connecting structure on a bottle neck; and a bottle neck comprising: a short tubular portion at the top of a bottle or similar container or receptacle and having an outer generally cylindrical surface extending to a top annular edge; cap connecting structure on the outer surface just below the top edge; and engaging structure below the cap connecting structure for engaging the engaging structure on the tamper evident ring.

DESCRIPTION OF THE PREFERRED EMBODIMENT(S)

Figure 1:
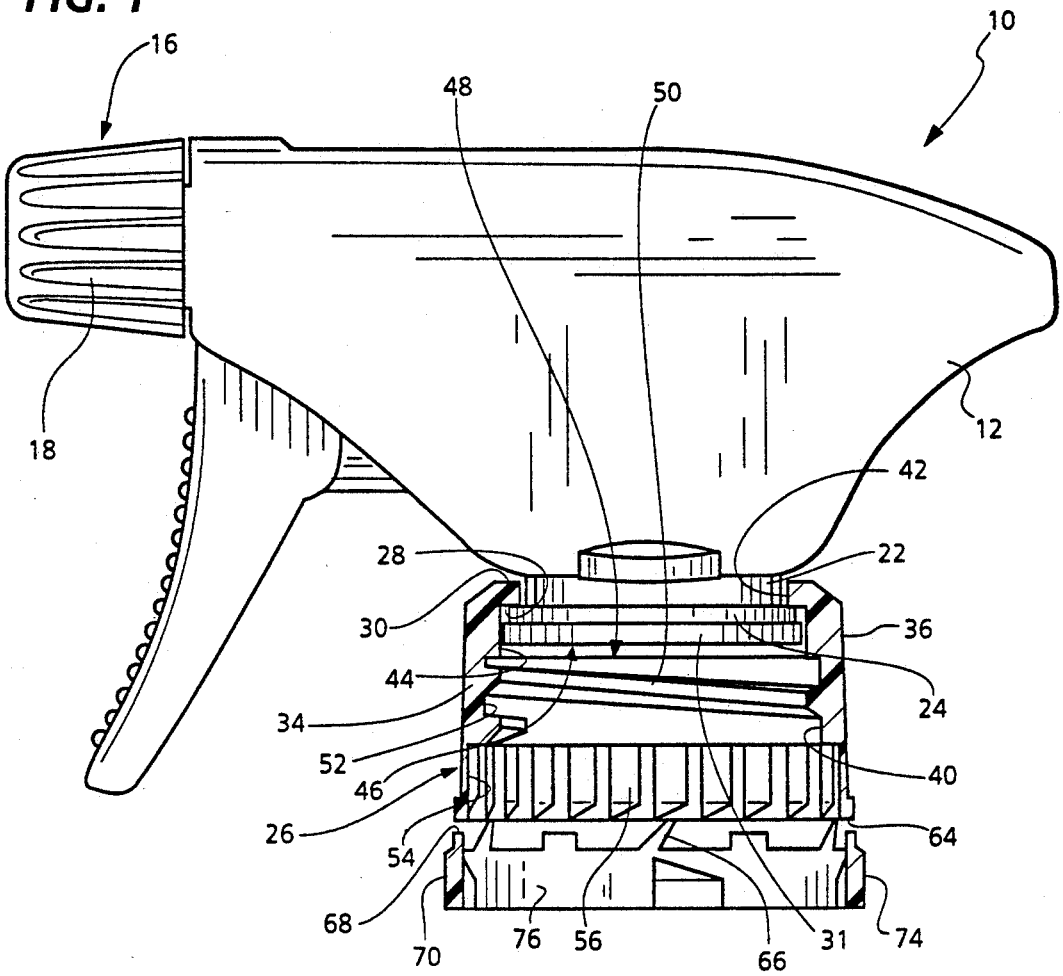
FIG. 1 is a side elevational view of a trigger sprayer with a bottle cap constructed according to the teachings of the present invention depending therefrom and shown in vertical section.

Referring now to the drawings in greater detail, there is illustrated in FIG. 1 a trigger sprayer 10 comprising a body 12, and a nozzle assembly 16 including a nozzle cap 18 mounted on a nose bushing (not shown) extending from the body 12. The trigger sprayer 10 also includes a fluid intake portion 22 which has an annular flange 24 on the bottom thereof. The intake portion 22 with the annular flange 24 is adapted to be inserted upwardly through an open top bottle cap 26 constructed according to the teachings of the present invention with the annular flange 24 being received under and adjacent an inside shoulder 28 of an open top wall 30 of the cap 26 for mounting the cap 26 in a depending relationship from the sprayer body 12. A gasket 31 is situated beneath the flange 26 and above a bottle neck 32 to prevent leaking.

According to the teachings of the present invention, the specially configured bottle cap 26 and a specially configured mating bottle neck 32 are provided in an assembly which provides evidence of tampering of the sprayer bottle cap/bottle neck assembly when the bottle cap 26 of the present invention is coupled to the bottle neck 32 (FIG. 2) of the present invention. When the bottle cap 26 is threaded onto the bottle neck the annular shoulder 28 is pressed against the upper surface of the retaining flange 24 which presses the gasket 31 against the top annular edge of the bottle neck 32 to seal the connection of the bottle cap 26 with the bottle neck 32.

Figure 3:
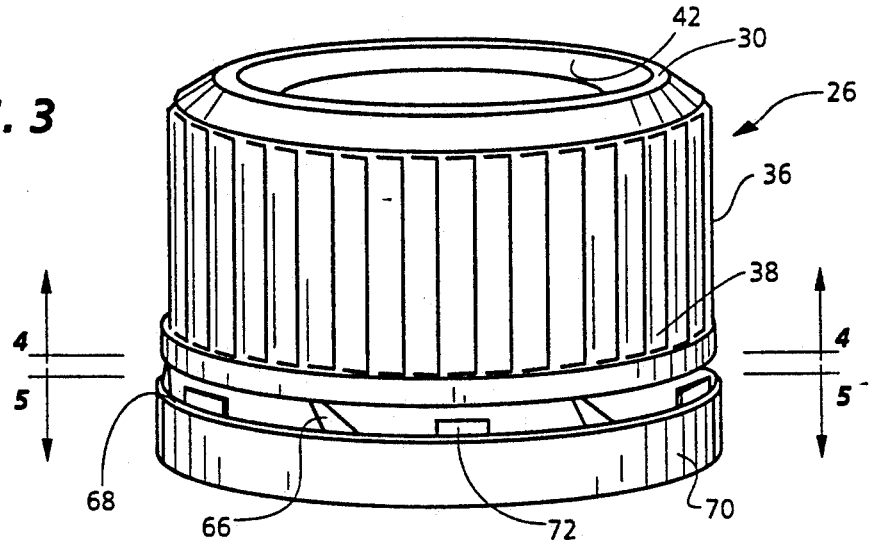
FIG. 3 is a perspective view of the bottle cap of the present invention.

As shown, the bottle cap 26 includes a cylindrical wall 34 having an outer cylindrical surface 36 which can be knurled, have bumps or splines thereon, or have a ramp formation 38 as shown in FIG. 3 and an inner surface 40 having structure to be described hereinafter. The cylindrical wall 34 extends downwardly from the top wall 30 which has a central opening 42 therein through which the intake portion 22 of the trigger sprayer 10 is inserted.

Beneath the open top wall 30 of the bottle cap 26 is a first cylindrical inner surface 44 forming a cylindrical cavity 46 for receiving the annular retaining flange 24 and the gasket 31. Beneath this cylindrical inner surface 44 there is formed on the inner surface 40, defining a second inner cylindrical surface 40 of the cylindrical wall 34, a thread 48 which has an outer ridge 50 approximately the same diameter as the first cylindrical inner surface 44 and an inner groove 52 between spiral turns of the thread 48 of slightly greater diameter.

Figure 4:
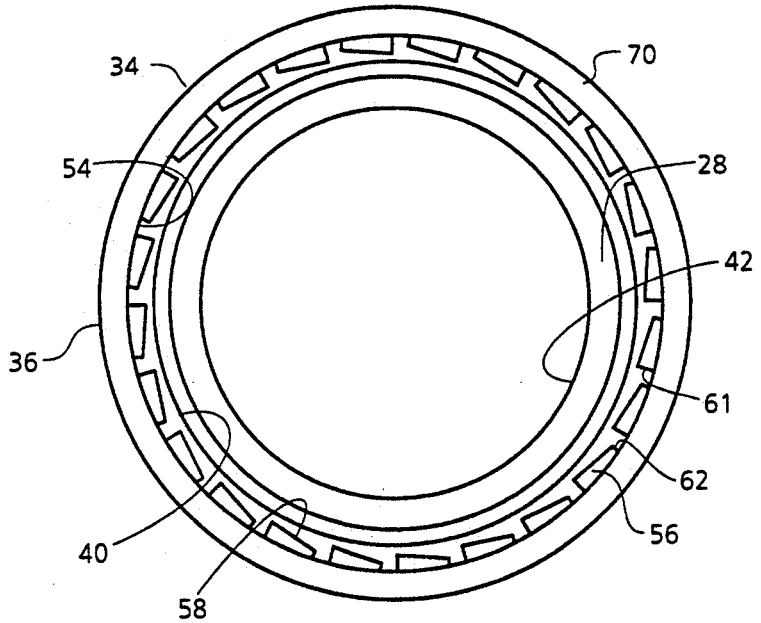
FIG. 4 is a horizontal sectional view through the cap shown in FIG. 3 and is taken along line 4—4 of FIG. 5 looking upwardly into the cap.

Then, formed beneath the inner surface 40 of the cylindrical wall 34 of the cap 26 on a third cylindrical inner surface 54 are a plurality of ratchet teeth 56 each of which has, as shown in FIG. 4, an inclined radially inwardly facing surface 58, side edges 61 and 62 which extend generally radially from the third cylindrical inner surface 54 of the cylindrical wall 34 which is of greater diameter than the diameter of the spiral groove 52 of the thread 48.

The cylindrical wall 34 has a lower annular edge 64 to which there is molded integrally therewith, webs or filets 66 which extend downwardly, at an angle to a vertical axis, to, and are integral with a top annular edge 68 of a tamper evident ring 70. The tamper evident ring 70 has six short generally rectangular bosses 72 extending upwardly from the annular edge 68 between each of the six webs or filets 66.

Figure 5:
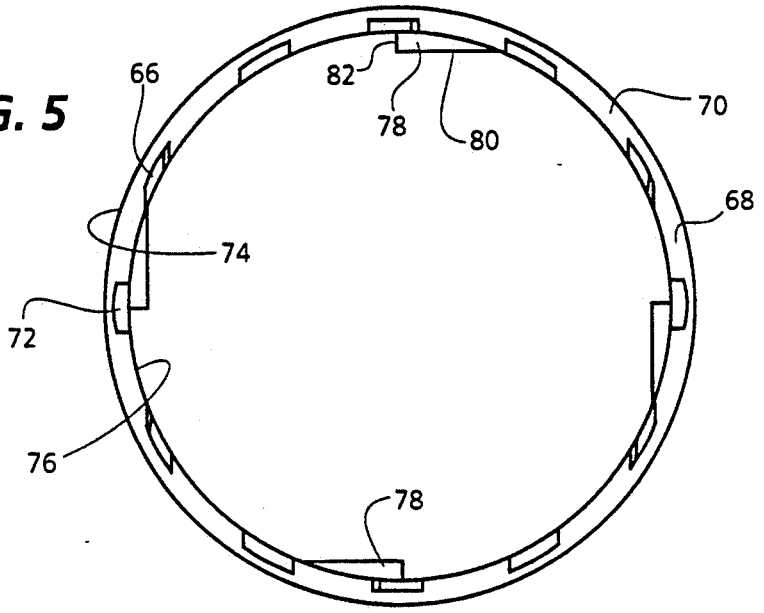
FIG. 5 is a horizontal sectional view of a tamper evident ring shown in FIG. 3 and is taken along line 5—5 of FIG. 3 looking downwardly into the tamper evident ring.

The tamper evident ring 70 has an outer cylindrical surface 74 greater than the outer cylindrical surface 36 of the cylindrical wall 34 and an inner cylindrical surface 76 which is greater than the third cylindrical inner surface 54 of the ratchet teeth 56. As best shown in FIGS. 1 and 5, four detents 78, equally spaced apart, are formed on the inner cylindrical surface 76 of the tamper evident ring 70 and each detent 78 has a first side surface 80 which is parallel to a tangent of the tamper evident ring 70 or stated otherwise, which lies on a chord of the tamper evident ring 70, and a second abutment surface 82 which extends radially inwardly from the inner cylindrical surface 76 of the tamper evident ring 70, as shown in FIG. 5. With this construction of the surfaces 80 and 82 of each of the detents 78, a ratchet formation is provided such that when the ring 70, as shown in FIG. 5, is rotated clockwise, the first surface 80 that is parallel to a tangent will slide over a ratchet type formation on the bottle neck 32, such as when the cap 26 is mounted on the bottle neck 32.

Then, when an attempt is made to rotate the tamper evident ring 70 shown in FIG. 5 in a counterclockwise direction, the second radially extending abutment surface 82 on each detent 78 is positioned to engage a stop or catch surface on two diametrically opposed bosses 84 on an outer surface 86 of a tubular portion 88 of the bottle neck 32 to prevent turning of the tamper evident ring 70. At that point, if continued twist/torque force is applied to the bottle cap 26, the webs or filets 66 will break and the broken away tamper evident ring 70 will be evidence of tampering with the ring 70 of the assembly.

The ratchet teeth 56 shown in FIG. 4 can be of the type shown in the Burke U.S. Pat. No. 4,345,691, or of the type disclosed and claimed in the Lindsey et al. U.S. Pat. No. 5,143,237, the disclosures of which are incorporated herein by reference.

Figure 2:
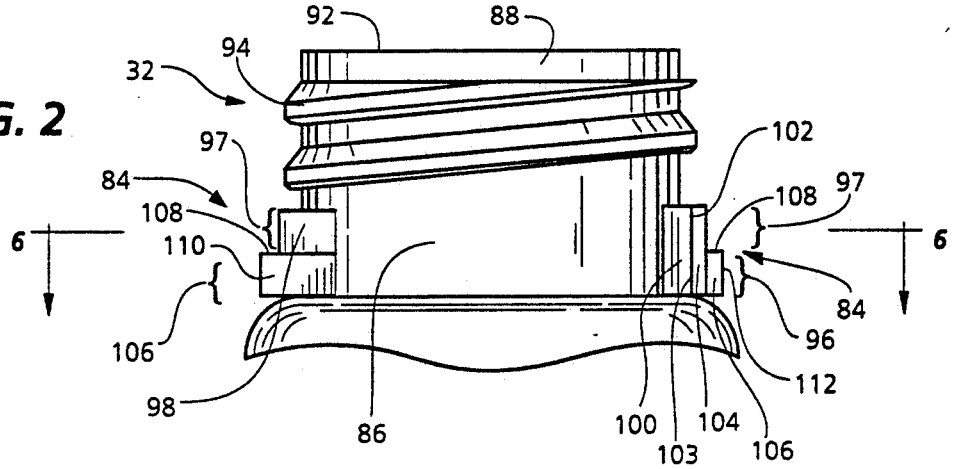
FIG. 2 is a side elevational view of a bottle neck constructed according to the teachings of the present invention, with portions of the bottle neck broken away, juxtaposed beneath the bottle cap shown in FIG. 1.
Figure 6:
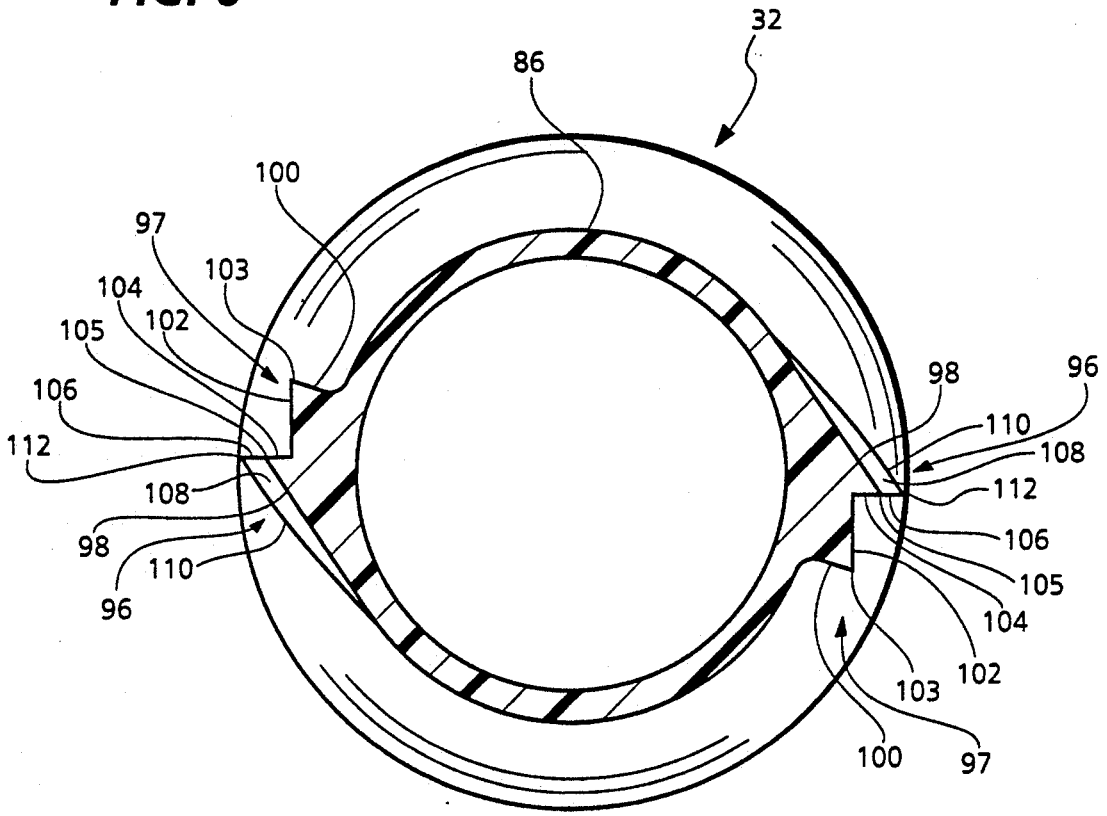
FIG. 6 is a horizontal sectional view of a lower portion of the bottle neck and is taken along line 6—6 of FIG. 2.

With reference now to FIGS. 2 and 6, it will be apparent that the tubular portion of the bottle neck 32 has an inner cylindrical surface 90 and the outer surface 86, as well as a top annular edge 92. Beneath the top annular edge 92 is a thread formation 94, as shown in FIG. 2, adapted to mate with the threads 48 within the cylindrical wall 34 of the cap 26. Beneath the thread formation 94 on the outer surface 86 of the tubular portion 88 are the diametrically opposed specially configured bosses 84 which are best shown in the cross-sectional view of same in FIG. 6.

The ratchet teeth 56 on the third lower inner cylindrical surface 54 of the cylindrical wall 34 of the cap 26 form an anti turn/twist off structure which is adapted to engage and ratchet with a portion of the two bosses 84 which also form anti turn/twist off structure on the bottle neck 32.

Again, as best shown in FIG. 6, each boss 84 has a lower rib like portion 96 for engaging the detents 78 on the tamper evident ring 70 and an upper rib like portion 97 for engaging the ratchet teeth 56 on the inside of the cap 26.

The upper rib like portion 97 has a ramp-like surface 98 extending along a tangent from the outer surface 86 of the tubular portion 88. Then, the upper rib like portion 97 of the boss 84 has an upper, ratchet teeth engaging, stop surface 100 opposite the inclined surface 98 which extends upwardly and generally radially outwardly from the outer surface 86 of the tubular portion 88 to an outward surface 102.

The upper stop surface 100 forms part of an anti turn/twist off structure for the ratchet teeth 56 on the lower cylindrical inner surface 54 of the cylindrical wall 34 of the cap 26, and the ramp-like surface 98 allows ratcheting of the ratchet teeth 56 over the ramp-like surface 98 of each upper rib like portion 97 of each boss 84.

The stop surface 100 extends to the outward surface 102 which is outward of the outer surface 86 and intersects and makes an acute angle with the stop surface 100 forming a tooth or edge 103. The stop surface 102 extends to a generally radially extending second stop surface 104 that extends to the ramp-like surface 98 and forms an acute angle therewith defining a tooth or edge 105. The second stop surface 104 on each boss 84 also serves to catch and stop the ratchet teeth 56 and forms part of the anti twist/turn off structure.

Then, the lower rib like portion 96 extends downwardly and generally outwardly from the ramp-like surface 98 and from the outward surface 102 of each boss 84 with a continuation 106 of the surface 104 and has an upwardly facing shoulder 108, as shown in FIGS. 2 and 6. Each lower (and outer) rib like portion 96 includes a second ramp-like surface 110 that extends on a tangent outwardly from the outer cylindrical surface 86 to the continuation catch or stop surface 106 that extends inwardly from the second ramp-like surface 110 in a generally radial direction to the outward surface 102 and forms a tooth or edge 112 with the ramp-like surface 110.

It will be understood that the second ramp-like surface 110 on the lower rib like portion 96 will be engaged by the chordlike first surface 80 of each of the detents 78 on the tamper evident ring 70 which will slide or ratchet over the second ramp-like surface 110 of the lower rib like portion 96 of each boss 84. Then, when an attempt is made to rotate the tamper evident ring 70 (counterclockwise, as shown in FIG. 5), the stop surfaces 82 on the detents 56 will engage the catch surfaces 106 of the bosses 84 on the lower rib like portion 96 of each boss 84, thereby preventing twisting of the tamper evident ring 70. But, if sufficient twist or torque is applied to the cap 26, the tamper evident ring 70 will be broken away from the cap 26 upon breaking of the fillets 66, and such separation of the tamper evident ring 70 from the cap 26 will indicate tampering with the bottle cap 26.

From the foregoing description, it will be apparent that the bottle cap 26 and bottle neck 32 of the present invention and the assembly including the same have a number of advantages, some of which have been described above and others of which are inherent in the invention. Also it will be understood that modifications can be made to the tamper evident trigger sprayer bottle cap/bottle neck assembly without departing from the teachings of the present invention. Accordingly, the scope of the invention is only to be limited as necessitated by the accompanying claims.

I claim:

1. A tamper evident, child resistant trigger sprayer bottle cap/bottle neck assembly comprising:

a trigger sprayer including a body and a fluid intake portion, said fluid intake portion having retaining means protruding laterally outwardly therefrom for retaining an open top bottle cap thereon;

a bottle cap comprising a top portion, a cylindrical wall depending from said top portion, and a tamper evident ring depending from said cylindrical wall, said top portion having a central opening therein, said fluid intake portion extending upwardly through said central opening and said cap being supported on said retaining means;

sealing mans associated with said retaining means and said bottle cap for effecting a seal between them when said bottle cap is mounted on a bottle neck to a fully connected position, said tamper evident ring being frangibly connected to said cylindrical wall by a plurality of spaced apart easily breakable webs or filets molded to and extending between said tamper evident ring and said cylindrical wall of said open top bottle cap, having engaging means for engaging structure on a bottle neck, being a continuous ring without a pull tab, and being mounted to a fully connected position on the bottle neck when said bottle cap is mounted on a bottle neck to a fully connected position, and said cylindrical wall having bottle neck connecting means on the inside thereof engagable with cap connecting structure on a bottle neck and having anti turn/twist off means associated therewith and engagable with anti turn/twist off structure on a bottle neck;

and a bottle neck comprising:

a short tubular portion at the top of a bottle or similar container or receptacle and having an outer generally cylindrical surface extending to a top annular edge;

cap connecting structure on said outer surface just below said top edge;

anti turn/twist off structure on said outer surface beneath said cap connecting means;

and engaging structure below said anti turn/twist off structure for engaging said engaging means on said taper evident ring.

2. The assembly of claim 1 wherein said cap connecting means comprises a thread on the inside of said cylindrical wall of said cap.

3. The assembly of claim 1 wherein said anti turn/twist off means comprises ratchet teeth on the inside of said cylindrical wall of said cap.

4. The assembly of claim 1 wherein said engaging means is located on the inside of said tamper evident ring and comprises at least one detent.

5. The assembly of claim 4 wherein said detent is a projection having two sides.

6. The assembly of claim 5 wherein one side is generally perpendicular to a tangent to a circular periphery of said cylindrical wall.

7. The assembly of claim 5 wherein one side is generally parallel to a tangent of or is a chord of a circular periphery of said cylindrical wall.

8. The assembly of claim 1 wherein said engaging means comprises two diametrically opposed detents on the inside of said tamper evident ring.

9. The assembly of claim 1 wherein said engaging means comprises four equally spaced apart detents on the inner surface of said tamper evident ring.

10. The assembly of claim 1 wherein said cap connecting structure comprises a thread on the upper portion of the outer surface of said tubular portion.

11. The assembly of claim 1 wherein said anti turn/twist off structure comprises at least one ratchet type boss on said outer surface of said tubular portion.

12. The assembly of claim 11 wherein said boss has a ramp-like surface extending from said outer surface.

13. The assembly of claim 12 wherein said ramp-like surface extends along a tangent of said outer surface of said tubular portion.

14. The assembly of claim 11 wherein said boss includes a stop surface extending generally radially outwardly from said outer surface of said tubular portion and defining said anti turn/twist off structure.

15. The assembly of claim 14 wherein said stop surface extends along a radius perpendicular to a tangent of said outer surface of said tubular portion.

16. The assembly of claim 14 wherein said stop surface extends to an outward surface.

17. The assembly of claim 16 wherein said outward surface intersects said stop surface at an acute angle.

18. The assembly of claim 11 wherein said boss has a ramp-like surface extending along a tangent to and from said outer surface to a catch surface extending inwardly from said-ramp like surface and defining said engaging structure.

19. The assembly of claim 18 wherein said catch surface extends generally radially inwardly to an outward surface that extends transverse of said catch surface to a stop surface defining said anti twist/turn off structure.

20. The assembly of claim 19 wherein said surfaces of said boss extend generally coaxially with the axis of said tubular portion of said bottle neck.

21. The assembly of claim 11 including two diametrically opposed bosses on said outer surface.

22. The assembly of claim 1 wherein said cylindrical wall has a first generally cylindrical inner surface just below said top portion with a first diameter width and having said bottle connecting means thereon.

23. The assembly of claim 22 wherein said cylindrical wall has a second inner cylindrical surface having a second diameter greater than said first diameter and having said anti turn/twist off means thereon.

24. The assembly of claim 23 wherein said tamper evident ring has an inner cylindrical surface having a third diameter greater than said second diameter and having said engaging means thereon.

25. A tamper evident, child resistant trigger sprayer bottle cap/bottle neck assembly comprising:

a trigger sprayer including a body and a fluid intake portion, said fluid intake portion having retaining means protruding laterally outwardly therefrom for retaining an open top bottle cap thereon;

a bottle cap comprising a top portion, a cylindrical wall depending from said top portion, and a tamper evident ring depending from said cylindrical wall, said top portion having a central opening therein, said fluid intake portion extending upwardly through said central opening and said cap being supported on said retaining means;

sealing means associated with said retaining means and said bottle cap for effecting a seal between them when said bottle cap is mounted on a bottle neck to a fully connected position, said tamper evident ring being frangibly connected to said cylindrical wall by a plurality of spaced apart easily breakable webs or filets molded to and extending between said tamper evident ring and said cylindrical wall of said open top bottle cap, having engaging means for engaging structure on a bottle neck, being a continuous ring without a pull tab, and being mounted to a fully connected position on the bottle neck when said bottle cap is mounted on a bottle neck to a fully connected position, and said cylindrical wall having bottle neck connecting means on the inside thereof engagable with cap connecting structure on a bottle neck;

and a bottle neck comprising:

a short tubular portion at the tope of a bottle or similar container or receptacle and having an outer generally cylindrical surface extending to a top annular edge;

cap connecting structure on said outer surface just below said top edge; and, engaging structure below said cap connecting structure for engaging said engaging means on said tamper evident ring.

26. A tamper evident, child resistant trigger sprayer bottle cap which has an open top and which is used with a trigger sprayer including a body and a fluid intake portion, the fluid intake portion having retaining means protruding laterally outwardly therefrom for retaining said open top bottle cap thereon, said bottle cap comprising:

a top portion, a cylindrical wall depending from said top portion, and a tamper evident ring depending from said cylindrical wall, said top portion having a central opening therein, said fluid intake portion extending upwardly through said central opening and said cap being supported on said retaining means;

sealing means associated with said retaining means and said bottle cap for effecting a seal between them when said bottle cap is mounted on a bottle neck to a fully connected position, said tamper evident ring being frangibly connected to said cylindrical wall by a plurality of spaced apart easily breakable webs or filets molded to and extending between said tamper evident ring and said cylindrical wall of said open top bottle cap, having engaging means for engaging structure on a bottle neck, being a continuous ring without a pull tab, and being mounted to a fully connected position on the bottle neck when said bottle cap is mounted on a bottle neck to a fully connected position, and said cylindrical wall having bottle neck connecting means on the inside thereof for engaging cap connecting structure on a bottle neck.

27. A tamper evident, child resistant trigger sprayer bottle cap which has an open top and which is used with a trigger sprayer including a body and a fluid intake portion, the fluid intake portion having retaining means protruding laterally outwardly therefrom for retaining said open top bottle cap thereon, said bottle cap comprising:

a top portion, a cylindrical wall depending from said top portion, and a tamper evident ring depending from said cylindrical wall, said top portion having a central opening therein, said fluid intake portion extending upwardly through said central opening and said cap being supported on said retaining means;

sealing means associated with said retaining means and said bottle cap for effecting a seal between them when said bottle cap is mounted on a bottle neck to a fully connected position, said tamper evident ring being frangibly connected to said cylindrical wall by a plurality of spaced apart easily breakable webs or filets molded to and extending between said tamper evident ring and said cylindrical wall of said open top bottle cap, having engaging means for engaging structure on a bottle neck, being a continuous ring without a pull tab, and being mounted to a fully connected pôsition on the bottle neck when said bottle cap is mounted on a bottle neck to a fully connected position, and said cylindrical wall having bottle neck connecting means on the inside thereof and having anti turn/twist off means associated therewith and engagable with anti turn/twist off structure on a bottle neck.

28. The bottle cap of claim 27 wherein said cap connecting means comprises a thread on the inside of said cylindrical wall of said cap.

29. The bottle cap of claim 27 wherein said anti turn/twist off means comprises ratchet teeth on the inside of said cylindrical wall of said cap.

30. The bottle cap of claim 27 wherein said engaging means is located on the inside of said tamper evident ring and comprises at least one detent.

31. The bottle cap of claim 30 wherein said detent is a projection having two sides.

32. The bottle cap of claim 30 wherein one side is generally perpendicular to a tangent to a circular periphery of said cylindrical wall.

33. The bottle cap of claim 30 wherein one side is generally parallel to a tangent of or is a chord of a circular periphery of said cylindrical wall.

34. The bottle cap of claim 27 wherein said engaging means comprises tow diametrically opposed detents on the inside of said tamper evident ring.

35. A bottle neck construction for use with a tamper evident, child resistant trigger sprayer bottle cap/bottle neck assembly used with a trigger sprayer including a body and a fluid intake portion, the fluid intake portion having retaining means protruding laterally outwardly therefrom for retaining an open top bottle cap thereon, said bottle neck construction comprising:

a short tubular portion at the top of a bottle or similar container or receptacle and having an outer generally cylindrical surface extending to a top annular edge;

cap connecting structure on said outer surface just below said top edge;

anti turn/twist off structure on said outer surface beneath said cap connecting means;

and engaging structure below said anti turn/twist off structure for engaging means on a tamper evident ring depending from the bottle cap, said anti turn/twist off structure comprising at least one ratchet type boss on said outer surface of said tubular portion, said boss having a ramp-like surface extending along a tangent to and from said outer surface to a catch surface extending inwardly from said ramp-like surface and defining said engaging structure and said catch surface extending generally radially inwardly to an outward surface that extends transverse of said catch surface to a stop surface that further defines said anti twist/turn off structure.

36. The bottle neck construction of claim 35 wherein said cap connecting structure comprises a thread on the upper portion of the outer surface of said tubular portion.

37. The bottle neck construction of claim 35 including two diametrically opposed ratchet shaped bosses on said outer surface of said tubular portion.

38. A bottle neck construction for use with a tamper evident, child resistant trigger sprayer bottle cap/bottle neck assembly used with a trigger sprayer including a body and a fluid intake portion, the fluid intake portion having retaining means protruding laterally outwardly therefrom for retaining an open top bottle cap thereon, said bottle neck construction comprising:

a short tubular portion at the top of a bottle or similar container or receptacle and having an outer generally cylindrical surface extending to a top annular edge;

cap connecting structure on said outer surface just below said top edge;

anti turn/twist off structure on said outer surface beneath said cap connecting means;

and engaging structure below said anti turn/twist off structure for engaging means on a tamper evident ring depending from the bottle cap, said anti turn/twist off structure comprising at least one ratchet type boss on said outer surface of said tubular portion, said boss including a stop surface extending generally radially outwardly from said outer surface of said tubular portion and defining further said anti turn/twist off structure, said stop surface extending along a radius perpendicular to a tangent of said outer surface of said tubular portion, and said stop surface extending to an outward surface that intersects said stop surface at an acute angle.

39. The bottle neck construction of claim 38 wherein said cap connecting structure comprises a thread on the upper portion of the outer surface of said tubular portion.

40. The bottle neck construction of claim 38 including two diametrically opposed ratchet shaped bosses on said outer surface of said tubular portion.

* * * * *